United States Patent [19]

Burroughs

[11] Patent Number: 4,749,968

[45] Date of Patent: Jun. 7, 1988

[54] JACK DEVICE

[75] Inventor: Dennis M. Burroughs, Savage, Minn.

[73] Assignee: ADC Telecommunications, Inc., Minneapolis, Minn.

[21] Appl. No.: 808,501

[22] Filed: Dec. 13, 1985

[51] Int. Cl.[4] ..... H01P 1/10

[52] U.S. Cl. ..... 333/105; 333/124; 333/262; 200/153 S; 335/5

[58] Field of Search ..... 333/101, 105, 124, 262; 200/153 S; 335/4, 5

[56] References Cited

U.S. PATENT DOCUMENTS

| | | | |
|---|---|---|---|
| 3,109,997 | 11/1963 | Giger et al. | 200/153 S X |
| 3,360,747 | 12/1967 | Lancaster | 333/105 |
| 3,372,349 | 3/1968 | Concelman | 333/105 |
| 3,373,360 | 3/1968 | Wilson | 333/105 X |
| 3,529,264 | 9/1970 | Lancaster | 333/101 |
| 3,946,390 | 3/1976 | Alexander et al. | 343/702 |
| 4,087,151 | 5/1978 | Robert et al. | 339/176 MP |
| 4,099,825 | 7/1978 | Jackson | 339/177 E |
| 4,224,485 | 9/1980 | Krumreich | 200/51.1 |
| 4,286,335 | 8/1981 | Eichler et al. | 455/89 |
| 4,393,283 | 7/1983 | Masuda | 200/51.09 |
| 4,477,134 | 10/1984 | Wright | 339/17 F |
| 4,559,421 | 12/1985 | Lapke et al. | 200/51.1 |
| 4,575,694 | 3/1986 | Lapke et al. | 333/22 R |

FOREIGN PATENT DOCUMENTS

| | | | |
|---|---|---|---|
| 0658424 | 2/1963 | Canada | 333/101 |

OTHER PUBLICATIONS

Photograph and advertising sheet SJ1000 Jack Mfg., and sold by ADC Telecommunicatons, Minneapolis, Minn.

Photograph and advertising sheet SJ2000 Jack Mfg., and sold by ADC Telecommunications, Minneapolis, Minn.

Photograph and advertising sheet of radio jack sold by King's Electronics Co., Inc., Tuckahoe, N.Y.

Photograph and advertising sheet of Patch Jack, sold by Trumpeter Electronics, Thousand Oaks, Calif.

Photograph of Jack, sold by Western Electric Company, AT&T technologies, Berkeley Heights, N.J.

Reference data for Radio Engineers, Howard W. Sams & Co., Inc., Indianapolis, Ind., pp. 24–21 to 27–27.

*Primary Examiner*—Eugene R. LaRoche
*Assistant Examiner*—Seung Ham
*Attorney, Agent, or Firm*—Merchant, Gould, Smith, Edel, Welter & Schmidt

[57] ABSTRACT

The disclosure is directed to a coaxial jack having a make before break switch in a first conductive path between signal-in mechanism and first signal-out mechanism. The switch is functioned on insertion of a plug is second signal-out mechanism which forms a second conductive path between said signal-in mechanism and said second signal-out mechanism. The jack not only matches impedances with the coaxial cables, but does so by equalizing inductive and capacitive reactances and by maintaining an impedance match at each structural support between a conductor in the jack and the housing of the jack. The housing of the jack is modular thereby providing superior versatility with respect to various configurations and applications.

22 Claims, 6 Drawing Sheets

JACK DEVICE

FIELD OF THE INVENTION

The present invention is directed to electrical equipment, and more particularly to jack assemblies for connecting two or more cables together for use, for example, in the telecommunications or broadcast industries.

BACKGROUND OF THE INVENTION

Transmission networks for analog signals, digital voice or digital data information are comprised increasingly of a complex interconnecting array of many types of equipment. Because the networks tend to be large and routed complexly, the various types of equipment provide for managability, test, maintenance, reconfiguration, and growth. Typically, a set of equipment is located in each of a number of facilities, such as telephone switching offices. The various facilities are interconnected in any of a variety of ways including coaxial cable, microwave, satellites, etc.

A crucial capability for any set of equipment in a transmission network is the ability to cross connect one piece of equipment to another. Such ability accommodates particularly maintenance, reconfiguration and test functions. Cross connection is accomplished by receiving a plug or other termination mechanism from one cable or other carrier and connecting in a suitable fashion to another plug or termination mechanism of another cable or carrier. The cross connection device may include additional access, such as for monitoring or testing.

Cross connect jack devices are known. Known devices, however, have a limited frequency range and limited versatility with respect to configuring for different situations. The present invention is directed to these and other novel features.

SUMMARY OF THE INVENTION

In one embodiment, the present invention is directed to a jack device for cross connecting a first coaxial cable with one of second and third coaxial cables. The jack device includes a housing, a mechanism for conducting an electrical signal through the housing, and a mechanism for supporting the conducting mechanism with respect to the housing. The housing includes a grounding mechanism for connecting between the coaxial cables. The conducting mechanism includes a mechanism for switching a signal from passing between the first and second coaxial cables to passing between the first and third coaxial cables, while at the same time having a characteristic impedance having approximately equal inductive and capacitive reactive components.

It is noted that as a signal passes through various equipments, a prime operating parameter is the matching of impedances of the equipments. Impedance has capacitive, inductive and resistive components. Capacitive and inductive components work to cancel one another. The present invention comprises a jack device having a characteristic impedance which advantageously includes approximately equal inductive and capacitive reactances. In this way, the induced capacitance as a result of the capacitor-like surfaces inherent in a switching mechanism are essentially neutralized.

The switching mechanism of the present invention is a unique make-before-break type. A spring conductor having opposite first and portions connected to a first central portion by first cantilever portions is held by a holding mechanism at the first central portion to the shells of the housing. A somewhat similar lever conductor having second end portions connected to a second central portion by second cantilever portions is also held by the holding mechanism. The first and second central portions are spaced apart. When a plug from a coaxial cable is inserted into the housing, the plug contacts one of the second cantilever portions and forces a second end portion against one of the first cantilever portions thereby wiping along it and making contact. As the plug continues to force the second cantilever portion, the first cantilever portion is moved so that the appropriate first end portion of the spring conductor wipes along a conductor now in continuity with the plug and breaks contact from it. The switch advantageously is formed to provide a wiping action at each of the contacting surfaces. In addition, the second central portion is connected through a resistor to the housing thereby providing a load to ground for the circuit which is disconnected.

In another embodiment, the jack device includes a housing for connecting a first coaxial cable with a second coaxial cable. The housing includes a passageway therethrough and mechanism for maintaining a ground connection between the cables. The jack device of this embodiment further includes conducting mechanism having an elongated connector member and mechanism for supporting the conducting member with respect to the housing. The supporting mechanism includes a dielectric support member having regularly spaced cavities about the conductor member. In this way the support member has a characteristic impedance which is approximately equal to the characteristic impedance of the first and second coaxial cables.

Since the space between the conducting member and the housing includes both the support member and regularly spaced cavities, the characteristic impedance may be made approximately the same as the characteristic impedance of the cables. The present invention, thus, not only provides for equalizing capacitive and inductive reactances, but also for supporting the conductive members such that the impedances of the supports are approximately the same as the impedance of the cables.

Yet another embodiment of the jack device of the present invention cross connects at least one input cable with at least one output cable and includes a housing, conducting mechanism and mechanism for supporting the conducting mechanism. The housing has front and rear modules. Each of the modules includes mechanism for receiving at least one of the termination means of the cables. The housing further includes a pair of shells for fitting about portions of the modules to hold the modules together.

The indicated housing is particularly advantageous because of its modular approach. The front module may have either one or two sleeves for receiving plugs. The sleeves may be of different diameters. The rear module may be formed with various types of mechanisms for receiving the termination means of a particular cable. For example, it may include one or two of any of a sleeve for receiving a bayonet connector, a sleeve for receiving a threaded connector, or a sleeve which may be crimped onto the coaxial or other cable. As a result, numerous configurational combinations may be created.

Thus, the present invention not only satisfies crucial electrical performance parameters, but provides for versatile configurational possibilities and other novel structural relationships. In addition to these various advantages and objects of the invention, others are also further explained and may be better understood by reference to the following drawings and the detailed descriptive matter thereafter.

DETAILED DESCRIPTION OF THE PREFERRED EMBODIMENT

Figure 1:
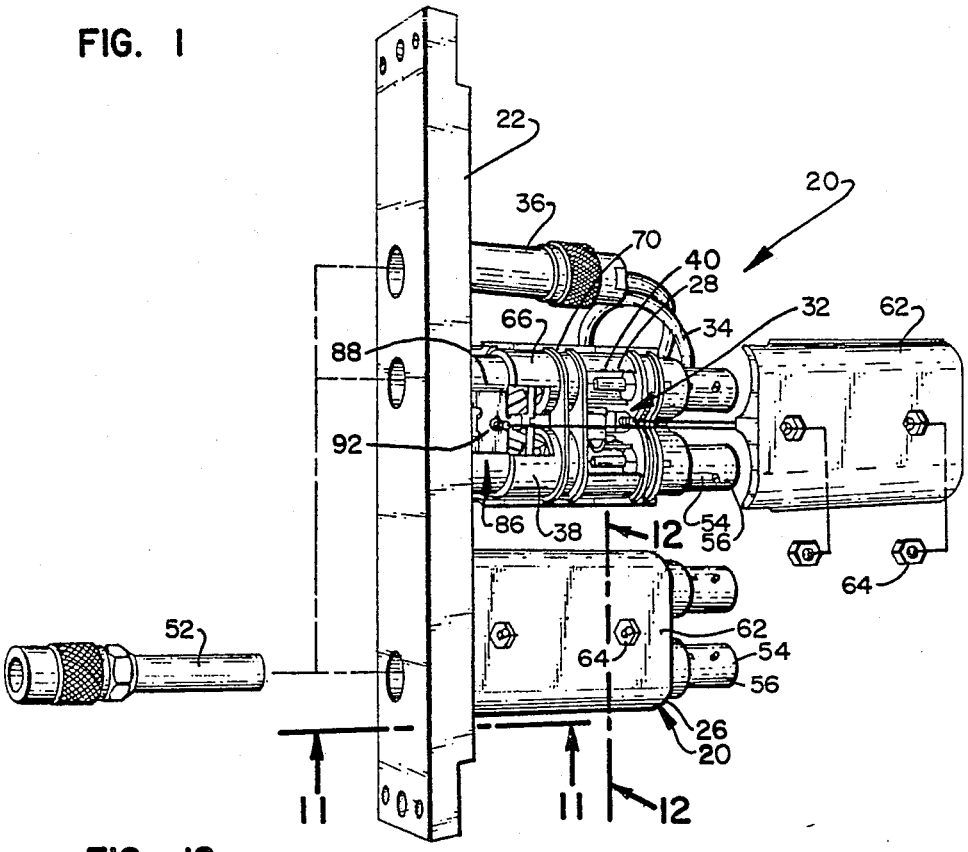
FIG. 1 is a perspective view of two different jack devices in accordance with the present invention as attached to a panel, a shell from one of the jack devices being exploded away from it while a plug is exploded away from connection with the other jack device.
Figure 11:
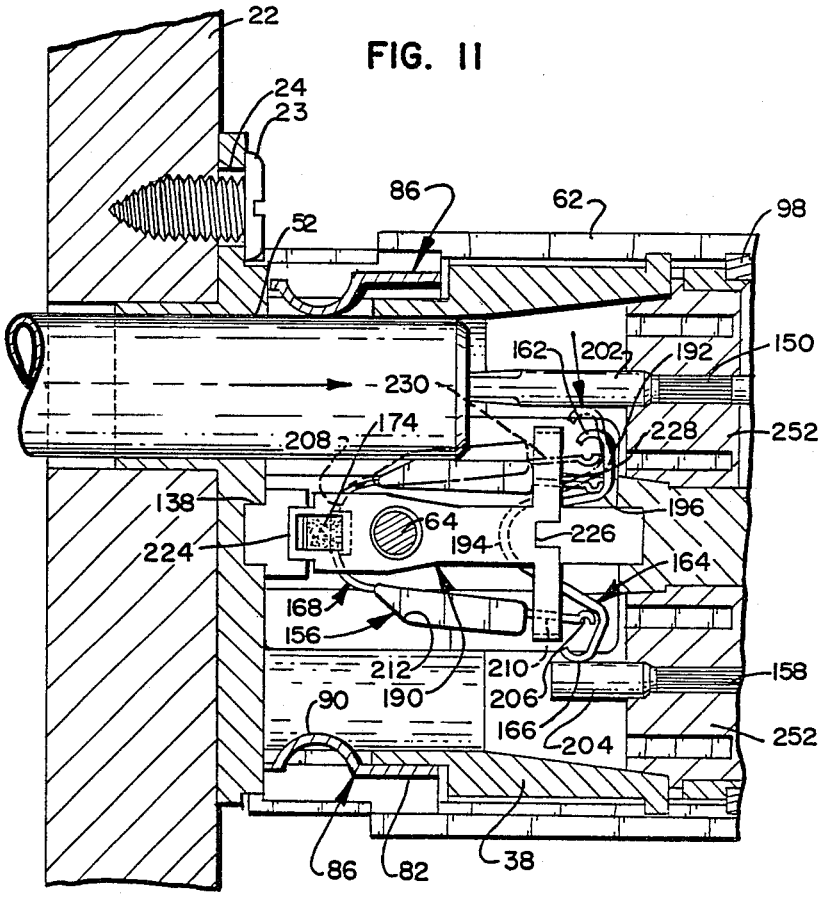
FIG. 11 is a cross-sectional view taken generally along line 11—11 of FIG. 1.

Referring now to the drawings wherein like reference numerals designate identical or corresponding parts throughout the several views, and more particularly to FIG. 1, a jack device in accordance with the present invention is designated generally as 20. Device 20 is attached to panel 22 with a screw 23 (see FIG. 11) passing through opening 24 and threading into a hole in panel 22. Jack device 20 includes a housing 26, a conducting mechanism 28, and mechanism 30 for supporting conducting mechanism 28 with respect to housing 26 (see FIG. 2). In addition, jack device 20 may include a mechanism 32 for monitoring the signal passing through device 20. Monitoring mechanism 32 includes a signal conducting cable 34 extending to, for example, a connecting jack 36 shown mounted to panel 22.

Figure 7:
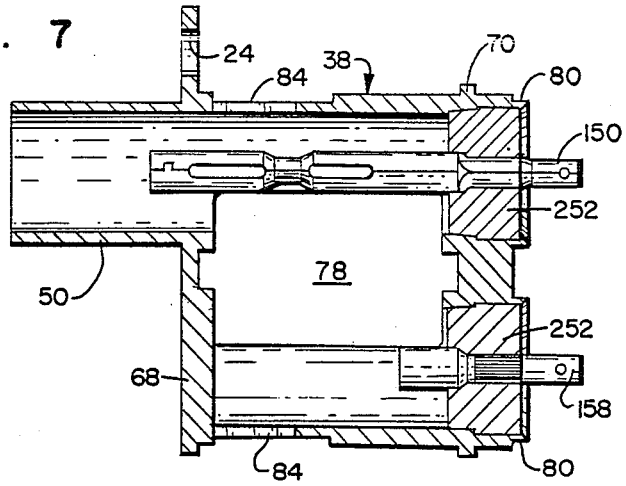
FIGS. 7–8 are cross-sectional views illustrating front modules having one or two sleeves in accordance with the present invention.
Figure 8:
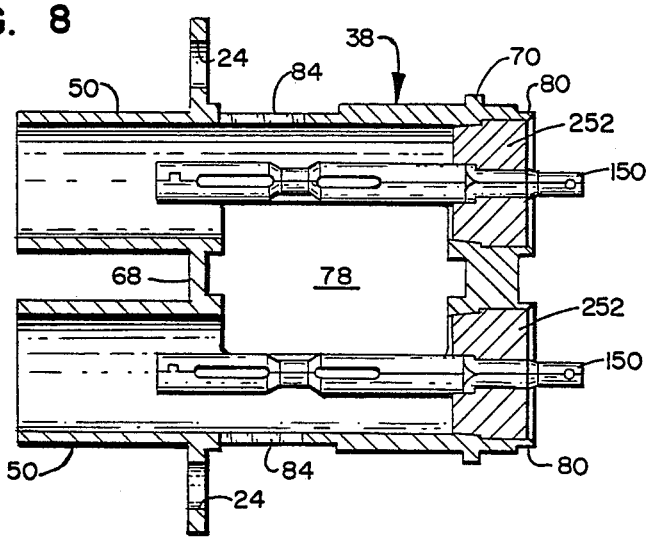
Figure 9:
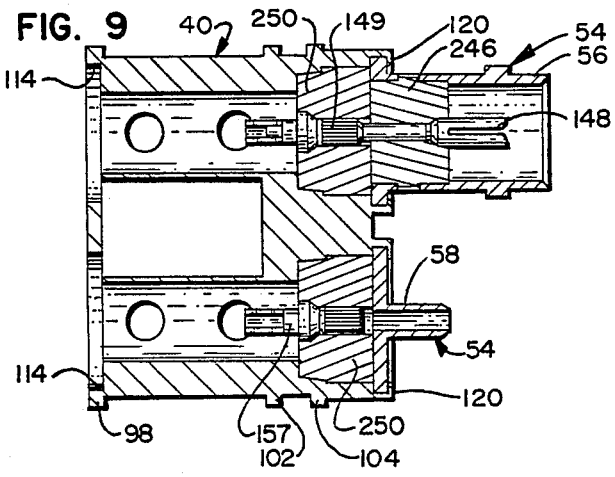
FIGS. 9 and 10 are cross-sectional views of a rear module in accordance with the present invention illustrating several different connecting sleeves.
Figure 10:
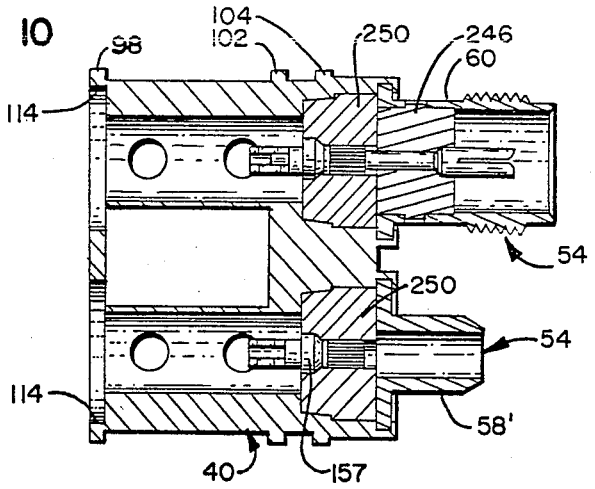

Housing 26 includes front and rear modules 38 and 40, respectively. Modules 38 and 40 have mating first ends 42 and 44 and opposing second ends 46 and 48. One or more sleeves 50 extend outwardly from the second end 46 of front module 38. A front module 38 having a single sleeve is shown in FIG. 7, while a front module 38 having two sleeves 50 is shown in FIG. 8. Sleeves 50 are formed to receive a connecting plug from a coaxial cable as shown, for example, in FIG. 1 at 52. Connecting sleeves 54 are attached to second end 48 of rear module 40. Jack device 20 is intended to have two sleeves 54 attached to rear module 40, but as shown in FIGS. 9 and 10, the sleeves may assume various forms. For example, FIG. 9 shows a conventional bayonet connector receiving sleeve 56 and a crimp sleeve 58 wherein the center conductor of a coaxial cable is attached to conductor 157 fastened in rear module 40. Sleeve 58 is crimped so as to make contact with and hold the shield of the cable. In FIG. 10 connecting sleeve 54 is shown in the form of a threaded sleeve 60 for receiving a standard threaded connector, and is also shown in the form of a larger crimp sleeve 58'. It is understood that numerous combinations of one or two sleeves 50 of various sizes may be formed as a part of front module 38 and that various combinations of the numerous connecting sleeves 54 may be attached to rear module 40 to give the assembly substantial versatility with respect to various termination mechanisms for coaxial cables or other appropriate signal carrying mechanisms. Front and rear modules 38 and 40 are held together by a pair of opposing shells 62 which are attached together with a pair of nut and bolt assemblies 64 as shown in FIG. 1. Front and rear modules 38 and 40, as well as sleeves 50 and connecting sleeves 54 are preferably conductive.

Figure 2:
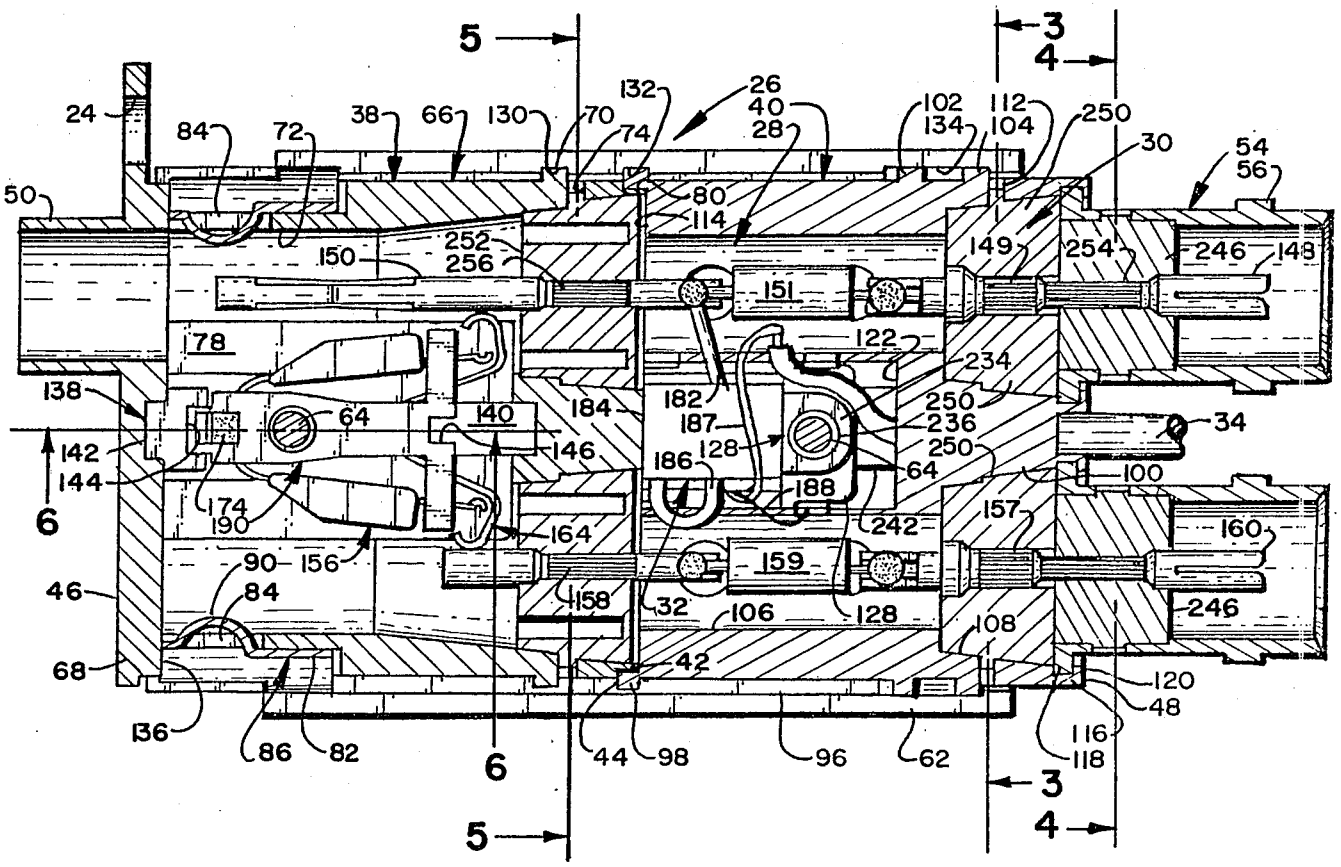
FIG. 2 is a cross-sectional view taken generally along the transverse mid-plane of the present invention.

As shown in FIGS. 1 and 2, front module 38 is formed as two parallel cylinders 66 held together in the parallel configuration by forward and rearward transverse bulkheads 68 and 70. Each cylinder 66 is formed to have an essentially cylindrical passageway 72 therethrough which is axially aligned with any sleeve 50 extending from front bulkhead 68 on the side opposite cylinder 66. The rearward portion of passageway 72 is inclinded in a frusto-conical shape to expand toward the rear. Just rearward of rear bulkhead 70 each cylinder wall includes a pair of openings 74. Also, the inclined wall of passageway 72 includes a plurality of regularly spaced grooves 76 (see FIG. 5). There is at least one groove 76 running axially and aligned with each opening 74. Grooves 76 are needed to receive protuberances 272 on support members 252 during assembly. The support members 252 fit into passageways 72 until the inclined side wall of support member 252 mates with the inclined wall of passageway 72 and the protuberances 272 fit into openings 74 to snugly hold the support member 252 in the end of passageway 72. In the region 78 between forward and rearward bulkheads 68 and 70, cylinders 66 are formed as half cylinders with only the opposing halves present. The enlarged empty region 78 is then available for switch mechanism 156 as discussed hereinafter. Each cylinder 66 also includes a short recess portion 80 at the rearward end in order to fit into a mating recess 114 in the forward bulkhead 98 of rear module 40. Another recess portion 82 is formed in the outer sidewall of cylinders 66 just rearward of forward bulkhead 68. Recess portion 82 extends along almost half the distance between forward and rearward bulkheads 68 and 70. Relatively large rectangular openings 84 are formed in the recess portions 82 of each cylinder 66 and are centered on the horizontal cross sectional plane of the jack device 20. Recess portion 82 is formed to receive ground spring 86. Ground spring 86 has end portions 88 (see FIG. 1) which wrap around the cylinders 66. Each end portion 88 includes a detent 90 which protrudes through an opening 84. When a plug 52 is inserted into sleeve 50, the outer surface of plug 52 contacts detent 90 and forces end portion 86 outwardly so that a spring force is maintained at the contact between ground spring 86 and the plug 52. The center portion 92 of ground spring 86 extends between the end portions 88 and is fastened in place with one of nut and bolt combinations 64. Centered at the forward end of ground spring 86 is a tab 94 (see FIG. 6) which is bent inwardly for the purpose of contacting a resistor 174 as discussed hereinafter.

Rear module 40 also includes a pair of parallel cylinders 96 held in the parallel configuration by a forward bulkhead 98 and a rearward connecting segment 100. Connecting segment 100 includes a pair of spaced apart ridges 102 and 104 running transversely about rear module 40. Ridges 102 and 104 have the general shape of forward bulkhead 98 and function in combination with it to longitudinally retain rear module 40 to shells 62. Cylinders 96 have cylindrical passageways 106 extending therethrough and being axially aligned with passageways 72 of forward module 38. The rearward ends of passageways 106 are larger than the rest of passageways 106 and have an inclined frusto-conical wall 108 expanding toward the rearward end. As with front module 38, wall 108 has a plurality of regularly spaced axially running grooves 110 (see FIG. 3). A pair of openings 112 pass through the walls of each cylinder 96 and are aligned with a pair of grooves 110. Support member 250 includes a protuberance 264 which slides along grooves 110 during installation. The outer side surface of support member 250 is frusto-conically shaped and mates with wall 108 at the point when the protuberances 264 enter into openings 112 to retain support member 250 in place.

Figure 12:
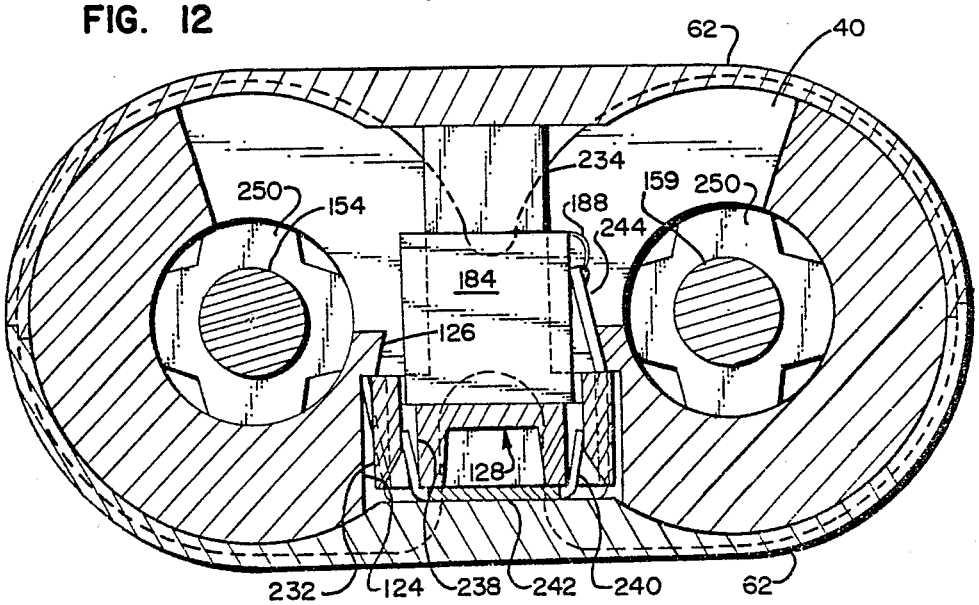
FIG. 12 is a cross-sectional view taken along line 12—12 of FIG. 2.

Forward bulkhead 98 of rear module 40 has a recess 114 in end 44 to receive end 42 of forward module 38. The outer perimeter of bulkhead 98 fits about recess 80 of module 38 while the end 42 of module 38 fits into recess 114 of rear module 40. The rear end 48 of rear module 40 has sleeve-like flanges 116 extending as projections of cylinders 96. Flanges 116 have thinner walls than the ends of cylinders 96 at the end of passageways 108 so that there is a circular shoulder 118 against which the end flanges 120 of connecting sleeves 54 butt. Flanges 116 are bent over flanges 120 to retain connecting sleeves 54 to rear module 40. As shown in FIGS. 1 and 12, about the upper, inner one-third of the cylindrical wall of cylinders 96 is missing to present an open area between forward bulkhead 98 and the forward wall 122 of connecting portion 100. The remainder of the facing walls of cylinders 96 have flat vertical surfaces 124 as shown in FIG. 12. The end of surfaces 124 includes an inward projection 126 for the purpose of retaining insulating holder 128 for monitoring components as described hereinafter.

Forward and rear modules 38 and 40 are retained together and the open spaces hereinbefore identified are covered by shells 62. Each shell 62 is identical. As shown in FIG. 2, shell 62 includes grooves 130, 132 and 134. Rear bulkhead 70 of forward modules 38 fits in groove 130. Forward bulkhead 68 butts against the forward end 136 of shell 62. In this way, front module 38 is prevented from moving longitudinally with respect to shells 62.

Front bulkhead 98 of rear module 40 fits in groove 132. Ridges 102 and 104 fit in wider groove 134. Bulkhead 98 and ridges 102 and 104 in grooves 132 and 134 retain rear module 40 against longitudinal movement with respect to shell 62. Shell 62 also includes front and rear posts 138 and 140, respectively. Front post 138 includes a forward extending portion 142 for fitting between cylinders 66 of module 38. Front post 138 also includes a rear groove 144 for receiving insulating holding members 200 of switch mechanism 156 as discussed hereinafter. Rear post 140 includes a forward tongue 146 for fitting into the rear end of holding members 200. Forward and rear posts 138 and 140 extend inwardly sufficiently far so that they pull against one another when upper and lower shells 62 are fastened together.

Electrical Circuit and Related Assemblies

Figure 13:
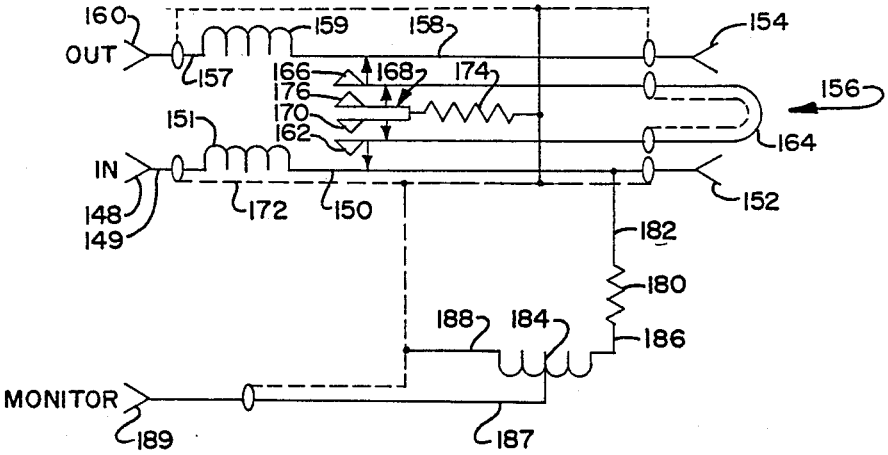
FIG. 13 is an electrical schematic of a jack device in accordance with the present invention.

An electrical schematic of jack device 20 is shown in FIG. 13. A signal is input at connecting end 148 of conductor 149 which is also connected to inductor 151. If a plug has been inserted in connecting end 152, then a signal passes directly through jack device 20 along conductor 150. If no plug has been inserted in either connecting end 152 or 154, then switch mechanism 156 directs the signal to conductor 158 for output through inductor 159 and conductor 157 at connecting end 160. If jack device 20 is used as a pass through connector, then a signal cannot only be input at connecting end 148 and passed through to connecting end 152, but also another signal may be input at connecting end 160 and passed through to connecting end 154. In that case, switch mechanism 156 would be disconnected from both conducting paths.

If a plug is not present in connecting ends 152 and 154, then end portion 162 of spring conductor 164 is forced against conductor 150 and directs the signal through conductor 164 to opposite end portion 166 which is likewise forced against conductor 158. If a plug is inserted in connecting end 152 as discussed hereinafter lever conductor 168 moves end portion 162 of spring conductor 164 away from conductor 150. Lever conductor 168 similarly moves end portion 166 from conductor 158 if a plug is inserted in connecting end 154. In the case when lever conductor 168 moves end portion 162 away from conductor 150, the circuit which includes connecting end 160, inductor 159, conductor 158, end portion 166 and switching conductor 164 is completed to ground 172 at end portion 170 and lever conductor 168 through resistor 174. Similarly, lever conductor 168 includes end portion 176 which functions to move switching end portion 166 if a plug is inserted in connecting end 154 and is connected to ground 172 through resistor 174.

Any signal conducted along line 150 may be monitored through resistor 180 via line 182. Resistor 180 is connected to inductor 184 via line 186. Inductor 184 is grounded at line 188. A monitoring line 187 is center tapped to inductor 184 and leads to connecting end 189.

It is understood that the monitor branch of the circuit shown in FIG. 13 is optional, as is connecting end 154. Furthermore, there are cases when a simple pass through circuit is all that is appropriate.

Several of the conductors, the switch assembly and the monitoring assembly are shown in FIG. 2. The conductors are discussed further hereinafter with reference to support members. The switch assembly 156 is shown in greater detail in FIG. 11. The switch assembly 156 includes spring conductor 164 and lever conductor 168 as held by a holding assembly 190. Spring conductor 164 is an elongated flat sheet having end portions 192 and a central portion 194 with cantilever portions 196 extending therebetween. Central portion 194 is held in a pair of aligned, facing arcuate slots 198 in holding members 200 (see FIG. 6). Central portion 194 curves rearwardly so that cantilever portion 196 extends diagonally rearwardly and sidewardly. At the end of cantilever portion 196, it mates with end portion 192 to extend sidewardly and slightly forwardly to forwardly extending arcuate end 202. The conductors 150 and 158 are cylindrical at the locations 202 and 204, where the arcuate ends 162 and 166 make contact with them. The curvatures of the arcuate ends 162 and 166 are approximately perpendicular to the curvatures of the cylindrical portions 202 and 204.

Lever conductor 168 also has end portions 206 and a central portion 208 connected together by cantilever portions 210. A dielectric sleeve 212 is formed about a segment of each of the cantilever portions 210 to provide a surface against which plug 52 may slide without making electrical contact with lever conductor 168. Similar to spring conductor 164, the central portion 208 of lever conductor 168 is curved rearwardly and held by holding members 200 in facing slots 214. Cantilever portions 210 extend rearwardly and slightly sidewardly from central portion 204. The end portions 206 are formed arcuately with inward curvatures. It is noted that central portion 208 has upper and lower tabs 216. There are upper and lower tabs for symmetry. One of the tabs contacts one end of resistor 174. Tabs 216 are located along the centerline of jack device 20 and are bent rearwardly at the top and bottom of central portion 204. One of the tabs 216 contacts one end of resistor 174 while tab 94 of ground spring 92 contacts the other end of resistor 174.

Holding members 200 are identical. Each has protrusions 218 slightly sidewardly from the centerline of jack device 20 and openings 220 for receiving the protrusions 218 of the other holding member 200. The openings are slightly off the centerline in the other direction from protrusions 218. As indicated, holding members 200 have facing slots 198 for receiving spring conductor 164 and facing slots 214 for receiving lever conductor 168. Slots 214 are forwardly of slots 198 and an opening 222 located between the pairs of slots extends completely through the holding members for the purpose of receiving the bolt of bolt and nut combination 64 in order to hold holding members 200 to shells 62. The forward end of holding members 200 includes a tongue 224 for fitting in groove 144 of post 138 on shell 62. In a similar fashion, the rearward end of holding members 200 includes a groove 226 for receiving tongue 146 of post 140 of shell 62. Holding members 200 also include arms 228 which extend in both sidewardly directions at the rear end of holding members 200. A retainer flange 230 extends in the direction of the arm on the other holding member 200. The retainer flanges 228 prevent the end portions 206 of lever conductor 168 from contacting the end portions 192 of spring conductor 164.

When plug 52 is inserted in sleeve 50, the outer surface of plug 52 contacts dielectric sleeve 212 and forces the cantilever portion 210 of lever conductor 168 inwardly. When end portion 206 of lever conductor 168 contacts cantilever portion 196 of spring conductor 164, it forces cantilever portion 196 inwardly thereby breaking contact between arcuate end 162 of end portion 192 and cylindrical portion 202 of conductor 150. It is noted that end portion 206 is arcuate and rubs along the inclined cantilever portion 196 thereby wiping and cleaning the contacting surface between the two conductors. Similarly, since end portion 192 angles forwardly and applies a spring force on cylindrical portion 202, when the spring force is overcome by lever conductor 168, arcuate end 162 wipes along and cleans the contacting surface between end 162 and cylindrical portion 202.

The monitoring branch of the circuit shown in FIG. 13, as indicated previously, is an optional feature. With reference to FIGS. 2 and 12, inductor 184 is shown. In addition, the conductors 182 and 186 leading to resistor 180 are indicated. Support member 128 holds inductor 184 and resistor 180. Support member 128 has a substantially rectangular base 232 to fit in the space between the straight walls 124 of cylinders 96 and between forward bulkhead 98 and wall 122 of rear module 40. A post 234 rises above base 232 and includes an opening 236 for receiving the bolt of a nut and bolt combination 64. The bottom of base 232 and the top of post 234 contact opposite shells 62. Base 232 includes a plurality of either recesses or channels 238 for receiving prongs 240 of an end member 242 connected to the ground wire of cable 34. One prong 244 of the plurality of prongs 240 extends through base 232 to provide a terminal for connection with wire 188 from inductor 184.

Impedance Considerations

Figure 14A:
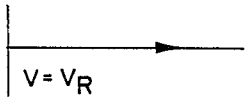
FIGS. 14A, 14B and 14C are illustrations of voltage phase diagrams.
Figure 14B:
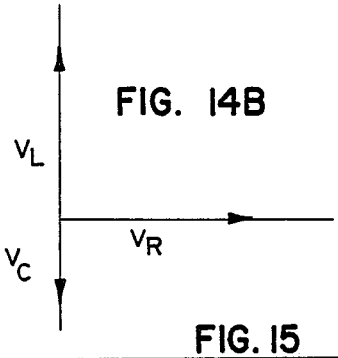
Figure 14C:
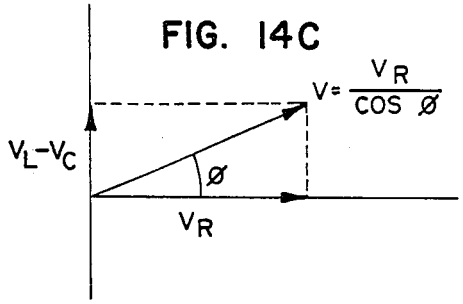

Since jack device 20 is intended to be an interconnecting mechanism for passing a signal from one transmission line to another, a crucial consideration is power transmission through the connecting device. In a direct current circuit, power is reduced at each resistive component. In an alternating current circuit, such as any circuit in which the present jack device 20 would be used, the same is true except for the resistive component one must more generally consider the effects of inductance and capacitance and consequently, the important parameter is impedance. Just as with any direct current circuit, in going from one conductor to another it is important to keep contact resistance low so that the resistance per unit length of the conductors is not increased at the contact, so with an alternating current circuit it is important to match the impedance from one device to another. Since impedance is related inversely to frequency, the problem of matching impedance is evermore difficult as frequencies rise. Consider the voltage diagrams in FIGS. 14A and 14B. In a simple circuit having, for example, simply resistance per unit length, current and voltage would be in phase and on a phase diagram voltage could be represented as shown in FIG. 14A. The power through such a simple circuit would be $P=VI$. In an alternating current circuit having an inductor and a capacitor as well as resistance per unit length, the phase relationship of voltage and current is altered by the inductor and capacitor. A phase diagram of typical component voltages is illustrated in FIG. 14B. A resolution of the voltage as shown in FIG. 14B is shown in FIG. 14C. In this case, voltage will lead current by a phase angle $\phi$. With respect to power transmission, there would be loss due to the reactive components, namely, the inductor and the capacitor which have caused the phase difference between the voltage and current. In other words, $V=V_R/\cos\phi$ or voltage would have to be increased by a factor of $1/\cos\phi$ to obtain the same output power as that of the simple circuit described with respect to FIG. 14A. The mismatch of reactive components has thus caused a power loss in transmission.

The present invention has addressed not only the performance parameter of impedance matching, but has also matched capacitive and inductive reactances so as to keep the voltage and current in phase through the jack device and thereby reduce any reactive power loss. The present invention represents a recognition not only of the necessity to match impedances from one conductive component to another throughout the transmission circuit in the jack device, but also of the desirability to equalize inductive and capacitive components of the impedance. For example, the end portion 192 of spring conductor 164 in switch mechanism 156 and the cylindrical wall 202 of conductor 150 provides surfaces of a type commonly found in capacitors. Consequently, there is an induced capacitive effect in jack device 20 as a result of the relationship of the switch surfaces. To counteract the capacitive reactance introduced by those surfaces, an inductor 151 is introduced between conductors 149 and 150. Similarly, inductor 159 is installed between conductors 157 and 158 to provide inductive reactance to counter the capacitive reactance of the other side of spring conductor 164.

Figure 15:
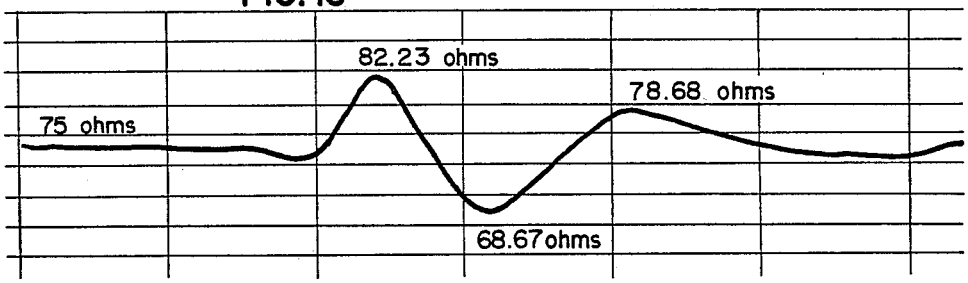
FIG. 15 is a graph of representative impedance encountered by a signal passing through a jack device in accordance with the present invention.

To determine the success of the indicated concept, an RG 59 B/U 75 ohm coaxial cable was connected to incoming connecting end 148 and a precision 75 ohm termination device was connected to connecting end 160. A time domain reflectometer was then appropriately connected to the coaxial cable. As a signal was transmitted, the graph of FIG. 15 showing the impedance characteristics of the circuit was developed. Rises above the straight 75 ohm line are due to inductive reactance, while rises below the line are due to capactive reactance. It is noted that the present invention resulted in both capacitive and inductive reactances which approximately canceled so as to relatively closely maintain an average 75 ohm impedance through jack device 20.

As a confirming test, a return loss measurement at frequencies from 100 hertz to 600 megahertz was made. The present invention held impedance within five percent of the impedance of the connected coaxial cable up to a frequency of 452 megahertz. Thus, not only has impedance been matched with the present jack device, but it has been done so throughout a wide range of frequencies.

When analyzing the distributed effects of geometry to the contributions to impedance, another part of jack device 20 which must be carefully considered are the support structures between the signal carrying conductors and the ground mechanism, preferably the conductive housing of present jack device 20. In a cable, the impedance between a conductor and a coaxial shield depends on the distance between the two items. If a substance other than air is inserted somewhere between the two items, for example, to hold the central conductor with respect to the outer shield, then a dielectric constant somewhat less efficient than air has been introduced and a different impedance results. Prior art connectors show solid disk-like support members between a central conductor and an outer conductive housing. The present invention is recognition of the possibility of not only varying the distance between the central conductor and the wall of the housing, or varying the substance for the support member thereby varying the dielectric constant, but is also recognition of the advantage which is achievable by using support members of geometries which incorporate both a dielectric material and air cavities between the central conductor and the wall of the conductive housing.

Conductor 149 is supported by support member 246 with respect to connecting sleeve 54 and is further supported by support member 250 with respect to rear module 40. Conductor 150 is supported by support member 252 with respect to front module 38. Conductors 157 and 158 in the other cylinders of front and rear modules 38 and 40 are similarly supported. Conductor 149 has a connecting end 148 for receiving a straight conductor of a mating plug. Conductor 149 also has a knurled portion 254 as well as enlarged ends at the rear end of support member 246 and the front end of support member 250 in order to rigidly retain conductor 149 to support members 246 and 250 and keep the conductors centered with respect to sleeve 54 and cylindrical wall 106. Similarly, conductor 150 has a forward end shaped to receive a straight conductor and has a knurled portion 256 for making good mechanical contact with support member 252 and keeping conductor 150 centered with respect to cylindrical wall 72 and cylindrical wall 106 of front and rear modules 38 and 40.

Figure 3:
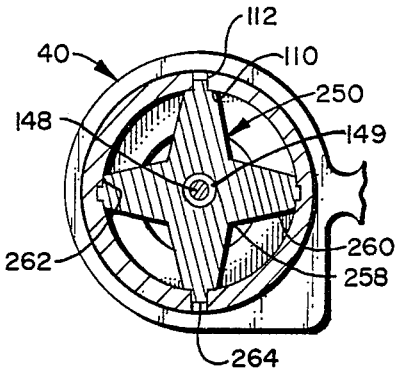
FIG. 3 is a cross-sectional view taken along line 3—3 of FIG. 2.
Figure 4:
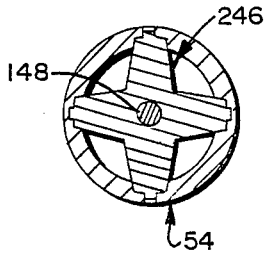
FIG. 4 is a cross-sectional view taken along line 4—4 of FIG. 2.

As shown in FIGS. 3 and 4, support members 246 and 250 are shaped similarly. Consider support member 250. Support member 250 has a central core 258 with an axial opening for receiving and holding conductor 149. A plurality of spokes 260 extend radially outwardly from core 258. The ends of each spoke 260 fit into one of the grooves 262 in the wall of cylinder 96. An opposing pair of spokes 260 each have a protuberance 264 for fitting into the openings 112 in the wall of cylinder 96. It is noted that the air spaces between spokes 260 preferably have a wedge-type shape are located in a space defined by the opposite ends of support member 250 and the wall of cylinder 96, and are regularly spaced about core 258.

Figure 5:
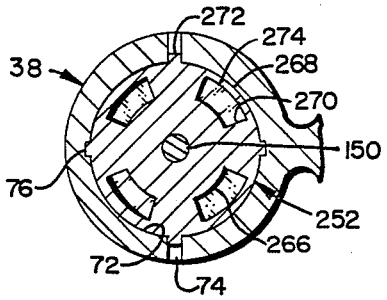
FIG. 5 is a cross-sectional view taken along line 5—5 of FIG. 2.
Figure 6:
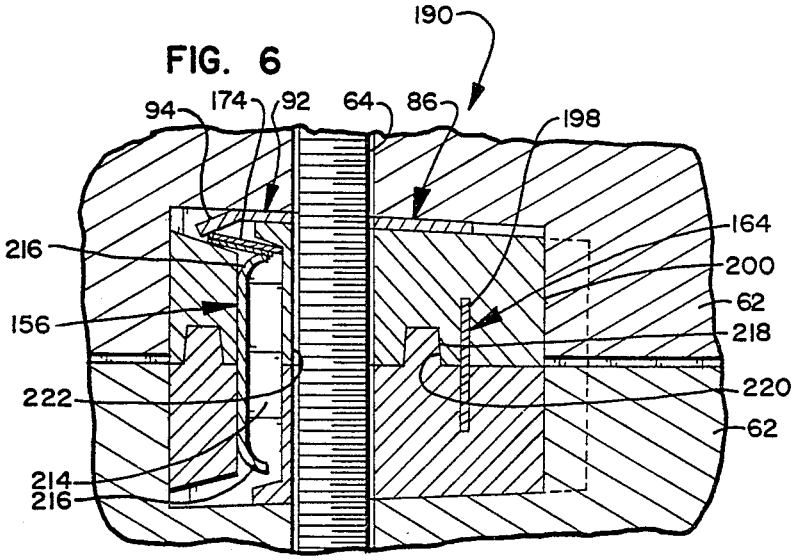
FIG. 6 is a cross-sectional view taken along line 6—6 of FIG. 2.

Support member 252 has a somewhat different shape as shown in FIG. 5. Support member 252 has a central core 266 and an outer ring 268 concentric with the central core 266 with the plurality of spokes 270 extending between core 266 and ring 268. Again, a pair of protuberances 272 are formed opposite from one another on the outer side of ring 270 and are aligned with grooves 76 in wall 72 and project into openings 74. The air cavities 274 are regularly spaced about central core 266 and form a portion of a wedge-like shape.

It is noted that the present invention makes it possible to use a desired material having a given dielectric constant while yet achieving impedance matching simply by designing a shape to include sufficient regularly spaced air cavities in order to alter the effective insulating quality of the support member.

Use

Jack device 20 is ordinarily attached to a panel 22 with one or more screws 23. Depending on the types of connecting sleeves 54 used at the rear end of rearward module 40, appropriate plugs, connectors or termination devices are installed thereto. Assuming then that a coaxial connection is made to both connecting sleeves 54 on rear module 40, a signal in at conductor 149 passes through inductor 151 and conductor 150 to spring conductor 164 of switch mechanism 156. From spring conductor 164, the signal continues along conductor 158 and through inductor 159 to conductor 157 and then to the connected cable.

If a plug 52 is inserted in sleeve 50 of forward module 38, plug 52 contacts dielectric sleeve 212 and forces end portion 206 of lever conductor 168 against cantilever portion 196 of spring conductor 164. Before arcuate end 162 of end portion 192 of spring conductor 164 breaks contact with cylindrical portion 202 of conductor 150, end portion 206 makes contact with cantilever portion 196. In this way, the circuit including conductor 157, inductor 159, conductor 158 terminates to ground through resistor 174 via spring conductor 164 and lever conductor 168. The housing of jack device 20 is conductive and is electrical ground. With plug 52 installed, a signal passes from conductor 149 through inductor 151 to conductor 150 and plug 52. The outer shell of plug 52 is grounded by springing detent 90 of ground spring 82 outwardly.

In a jack device 20 having a second sleeve 50 in front module 38, a plug inserted therein would function similar to insertion of plug 52 as just described. In that case, however, signals from the cables connected to the connecting sleeves 54 would pass directly through to cables connected to the connecting sleeves 50.

Jack device 20 may also include a monitoring circuit for recreating an input signal or for other purposes. If a plug is inserted in jack 36, any signal being conducted along conductor 149 passes through inductor 151 to resistor 180, inductor 184 and out on conductor 187 of cable 34 to jack 36. Signal amplitude is appropriately small so as not to affect power transmission.

As discussed hereinbefore, jack device 20 takes uniquely into account impedance matching characteristics of the support members for the conductors and also matches impedance in a way which results in approximately equivalent inductive and capacitive reactances. The present jack device not only provides for superior electrical performance, but also provides superior versatility with respect to a variety of configurations and, consequently, applications. The housing is modular. The forward module 38 may include one or more sleeves 50 of various diameters. Rear module 40 may include various connecting sleeves 54. Uses range from direct pass through to patching in another line and terminating the output line through a resistor to ground, as well as to monitoring. Other uses and applications have also been indicated. In spite of the details of structure and function which have been set forth at length, it is nevertheless also understood that changes may be made. Consequently, equivalent modifications are also within the principle of the present invention to the full extent extended by the general meaning of the terms in which the appended claims are expressed.

What is claimed is:

1. A jack device for cross connecting a first coaxial cable with one of second and third coaxial cables, said first and second coaxial cables each having termination means, said third coaxial cable terminating in a plug, said first, second and third coaxial cables having approximately equivalent first characteristic impedances, said jack device comprising:

a housing having signal-in means for connecting with said first coaxial cable and first and second signal-out means for connecting with at least one of said termination means of said second coaxial cable and said plug of said third coaxial cable, respectively, said housing including grounding means for connecting to said first, second and third coaxial cables;

means for conducting an electrical signal from said signal-in means to said first and second signal-out means, said conducting means including means for switching said signal from said first signal-out means to said second signal-out means on insertion of said plug, said conducting means further including first means for creating a second characteristic impedance having approximately equal inductive and capactive reactive components when said signal-in means is connected to said first signal-out means and second means for creating a third characteristic impedance having approximately equal inductive and capacitive reactive components when said signal-in means is connected to said second signal-out means, said first creating means including a first inductor, said second creating means including a second inductor; and means for supporting said conducting means with respect to said housing.

2. A jack device according to claim 1 comprising a fourth signal-out means including means sized to accommodate insertion of said plug at a third location, said conducting means including means for electrically connecting said fourth signal-out means and said signal-in means and including components having an electrical resistance selected for said third cable to receive a signal from said signal-in means upon insertion of said plug into said third location without breaking a signal from said signal-in means to said first signal-out means.

3. A jack device for cross connecting a first coaxial cable with a second coaxial cable, said first and second coaxial cables each having termination means, said first and second coaxial cables having approximately equivalent first characteristic impedances, said jack device comprising:

a housing having signal-in means for connecting with said termination means of said first coaxial cable and signal-out means for connecting with said termination means of said second coaxial cable, said housing including a passageway having a wall, said passageway for extending between said signal-in means and said signal-out means, said housing including grounding means for connecting to said first and second coaxial cables;

means for conducting an electrical signal from said signal-in means to said signal-out means, said conducting means including an elongated conductor member; and means for supporting said conducting means with respect to said housing, said supporting means including a dielectric support member for supporting said conductor member, said support member having opposite ends and an outer edge for fitting against said wall, said wall and said opposite ends of said support member defining a space, said space including said support member and a plurality of regularly spaced cavities with respect to said conductor member, said support member having a second characteristic impedance, said second characteristic impedance being approximately equal to said first characteristic impedance.

4. A jack device for cross connecting a first coaxial cable with one of second and third coaxial cables, said first and second coaxial cables having termination means, said third coaxial cable terminating in a plug, said first, second and third coaxial cables having approximately equivalent first characteristic impedances, said jack device comprising:

a housing having signal-in means for connecting with said first coaxial cable and first and second signal-out means for connecting with at least one of said termination means of said second coaxial cable and said plug of said third coaxial cable, respectively, said housing including grounding means for connecting to said first, second and third coaxial cables, said housing including a plurality of passageways having walls, said passageways for extending between said signal-in means and said first and second signal-out means;

means for conducting an electrical signal from said signal-in means to said first and second signal-out means, said conducting means including an elongated conductor member, said conducting means including means for switching said signal from said first signal-out means to said second signal-out means on insertion of said plug, said conducting means further including means for creating a second characteristic impedance having approximately equal inductive and capacitive reactive components when said signal-in means is connected to said first signal-out means and second means for creating a third characteristic impedance having approximately equal inductive and capactive reactive components when said signal-in means is connected to said second signal-out means, said first creating means including a first inductor, said second creating means including a second inductor; and means for supporting said conducting means with respect to said housing, said supporting means including a dielectric support member extending in a transverse space between said elongated conductor member and one of said walls of one of said passageways of said housing, said support member having opposing ends, said transverse space having identical said opposing ends, said transverse space including regularly spaced cavities about said conductor member, said supporting means having a fourth characteristic impedance, said second, third and fourth characteristic impedances being approximately equal to said first characteristic impedance.

5. The device in accordance with claim 4 wherein said support member is formed to include a core for holding said conductor member and a plurality of spokes extending from said core to said one of said walls of said housing.

6. The device in accordance with claim 4 wherein said one wall of said one of said passageways is conically inclined and further includes a pair of longitudinally-extending, opposing grooves therein, each of said grooves including a recess therein, and wherein said support member has an outer edge with a pair of protuberances, one of said protuberances being on a side of said edge opposite the other, whereby said protuberances slide in said grooves during assembly and fit into said recesses thereby retaining said support member in said housing.

7. A jack device for cross connecting a first coaxial cable with one of second and third coaxial cables, said first and second coaxial cables having first and second termination means, respectively, and said third coaxial cable terminating in a plug, said first, second and third coaxial cables having first, second and third central conductors and first, conductor and said first shield, said second conductor and said second shield, and said third conductor and said third shield having approximately equivalent first characteristic impedances therebetween, said jack device comprising:

a housing having signal-in means for connecting with said first termination means of said first coaxial cable and first and second signal-out means for connecting with said second termination means of said second coaxial cable and said plug of said third coaxial cable, respectively, said housing also including a plurality of passageways having walls, said passageways for extending between said signal-in means and said first and second signal-out means, said housing being conductive for maintaining a ground continuity with said first, second and third shields;

means for conducting an electrical signal along one of first and second conductive paths, said first path extending between said signal-in means and said first signal-out means, said first path for being in electrical communication with said first and second central conductors, said second path extending between said signal-in means and said second signal-out means, said second path for being in electrical communication with said first and third central conductors, said conducting means including switching means for closing electrical continuity of said second central conductor to ground before opening electrical continuity in said first path on insertion of said plug; and means for supporting said conducting means with respect to said housing.

8. The device in accordance with claim 7 wherein said conducting means includes first and second conductor members, said first conductor member forming a portion of said first path, said second conductor member forming a portion of said second path, said switching means including spring means for conductively connecting said first and second conductors and lever means for forcing said spring means to separate from one of said first and second conductors.

9. The device in accordance with claim 8 wherein said lever means is conductive and wherein said switching means further includes an electrical resistor between said lever means and said housing.

10. The device in accordance with claim 8 wherein said lever means is conductive and includes means for making electrical contact with said spring means before said spring means is forced to separate from oen of said first and second conductors.

11. The device in accordance with claim 10 wherein said switching means includes means for holding said spring means and said lever means to said housing, wherein said first and second conductor members have cylindrical portions, and wherein said spring means includes an elongated first sheet member, said first sheet member having arcuate first end portions for contacting said cylindrical portions, the curvatures of said first end portions being approximately perpendicular to the curvatures of said cylindrical portions, said first sheet member having a first central portion for being held at a first location by said holding means and first cantilever portions for connecting said first central portion to said first end portions, each of said first end portions being shaped so as to wipe along one of said cylindrical portions when said lever means forces against one of said first cantilever portions.

12. The device in accordance with claim 11 wherein said lever means includes a second sheet member with arcuate second end portions for contacting the cantilever portions of said spring means, said second sheet member having a second central portion for being held at a second location by said holding means and second cantilever portions for connecting said second central portion to said second end portions, said second location being spaced from said first location, each of said second end portions being shaped so as to wipe along one of said first cantilever portions when one of said second cantilever portions is forced by said plug to move one of said second end portions against one of said first cantilever portions.

13. The device in accordance with claim 12 wherein said holding means includes a pair of interconnecting insulating support members, each of said support members including a first slot for receiving the first central portion of said first sheet member and a second slot for receiving the second central portion of said second sheet member, said first slots facing one another, said second slots facing one another.

14. The device in accordance with claim 13 wherein said holding means includes means for preventing said second end portions from contracting said first end portions.

15. The device in accordance with claim 11 wherein one of said first end portions of said first sheet member of said spring means and said first conductor create a capacitive reactance, and wherein said conducting means includes a third conductor, said third conductor forming a portion of said first path, said conducting means still further including an inductor, said inductor being connected between said first and third conductors and having an inductive reactance approximately equal to said capacitive reactance.

16. A jack device for cross connecting at least one input cable with at least one output cable, said input and said output cables each having termination means with a central conductor for conducting a signal, said jack device comprising:

a housing having front and rear modules with mating first ends and opposing second ends, each of said modules including means for receiving at least one of said termination means, said receiving means being attached at said second ends of said modules, said housing further including a pair of shells for fitting about portions of said modules to hold said modules together, said housing also including primary means for holding said shells together;

means for conducting said signal from said termination means for said input cable to said termination means for said output cable; and means for supporting said conducting means with respect to said front and rear modules.

17. The device in accordance with claim 15 wherein each of said front and rear modules includes a pair of parallel, aligned, side by side cylindrical members and a pair of spaced-apart bulkhead members for holding said cylindrical members parallel, said cylindrical members of said front and rear modules being aligned with one another, said cylindrical members including passageways for receiving said conducting means.

18. The jack device in accordance with claim 17 wherein each of said shells includes front auxiliary means for holding with respect to longitudinal movement said pair of bulkheads of said front module and rear auxiliary means for holding said rear module with respect to longitudinal movement.

19. The device in accordance with claim 17 wherein said housing is conductive and said jack device further includes spring means for making a ground contact between said front module and said termination means received by said receiving means of said front module and means for attaching said spring means to one of said pair of shells and said front module.

20. The device in accordance with claim 19 wherein said conducting means includes a first conductive line extending substantially coaxially through at least a portion of one of said passageways of an aligned first set of one of said cylinders of said rear module and one of said cylinders of said front module and a second conductive line extending coaxially through at least a portion of another of said passageways of an aligned second set of the other of said cylinders of said rear module and the other of said cylinders of said front module, said conducting means further including switching means for making and breaking conductive continuity between said first and second conductive lines, said front module including a first space between said pair of cylinders for receiving said switching means, said switching means being held securely in said first space by said front auxiliary holding means and said primary holding means.

21. The device in accordance with claim 20 wherein said switching means includes a resistor in electrical communication with said housing on one side, said switching means further including means for making electrical connection between said second conductive line and a second side of said resistor when one of said termination means is inserted in said front module in order to interconnect along said first conductive line with another of said termination means at said rear module.

22. The device in accordance with claim 21 wherein said electrical connection making means includes means for breaking electrical connection between said second conductive line and said resistor when additional termination means is inserted in said front module to make electrical contact along said second conductive line with additional termination means at said rear module.

* * * * *